US009695660B2

(12) United States Patent
Ruttley

(10) Patent No.: US 9,695,660 B2
(45) Date of Patent: Jul. 4, 2017

(54) WELL BORE CASING MILL WITH EXPANDABLE CUTTER BASES

(71) Applicant: Deltide Energy Services LLC, Harvey, LA (US)

(72) Inventor: David J. Ruttley, Marrero, LA (US)

(73) Assignee: ABRADO, INC., Houston, TX (US)

( * ) Notice: Subject to any disclaimer, the term of this patent is extended or adjusted under 35 U.S.C. 154(b) by 262 days.

(21) Appl. No.: 14/420,612

(22) PCT Filed: Aug. 6, 2013

(86) PCT No.: PCT/US2013/053770
§ 371 (c)(1),
(2) Date: Feb. 9, 2015

(87) PCT Pub. No.: WO2014/025763
PCT Pub. Date: Feb. 13, 2014

(65) Prior Publication Data

US 2015/0211315 A1 Jul. 30, 2015

Related U.S. Application Data

(60) Provisional application No. 61/681,670, filed on Aug. 10, 2012.

(51) Int. Cl.
*E21B 29/00* (2006.01)
*E21B 10/32* (2006.01)

(52) U.S. Cl.
CPC ..... *E21B 29/005* (2013.01)

(58) Field of Classification Search
CPC ..... E21B 10/32; E21B 10/327; E21B 10/46; E21B 10/56; E21B 2010/561; E21B 2010/562; E21B 10/567; E21B 10/5673; E21B 29/005; E21B 29/002
USPC ..... 166/55.6, 55.7, 55.8, 298; 175/39, 263, 175/267, 292, 384
See application file for complete search history.

(56) References Cited

U.S. PATENT DOCUMENTS 3,117,626 A * 1/1964 Ringler ..... E21B 29/005 166/55.7
5,460,233 A * 10/1995 Meany ..... E21B 10/5673 175/428
5,765,640 A * 6/1998 Milne ..... E21B 17/1021 166/206
5,871,060 A * 2/1999 Jensen ..... E21B 10/5735 175/420.2
5,899,268 A * 5/1999 Lynde ..... B23B 5/16 166/55.6
6,070,677 A * 6/2000 Johnston, Jr. ..... E21B 10/32 166/174

(Continued)

*Primary Examiner* — Kenneth L Thompson
(74) *Attorney, Agent, or Firm* — Law Office of Jesse D. Lambert, LLC

(57) ABSTRACT

A casing mill for downhole casing milling has multiple elongated cutter bases hingedly connected to a main body by a plurality of positioning arms. An operating mechanism within the main body of the casing mill, actuated by fluid flow, moves the cutter bases to an extended position. Multiple cutters fixed to the cutter bases are then positioned to engage a casing end surface. Preferably, the cutters are arranged in vertically spaced apart rows, such that when one row is worn out in the milling process a visual indication is seen at the surface, as the casing mill drops to the next row of cutters.

19 Claims, 6 Drawing Sheets

(56) References Cited

U.S. PATENT DOCUMENTS

| | | | | |
|---|---|---|---|---|
| 7,770,664 | B2 * | 8/2010 | Laird | E21B 12/02 175/284 |
| 2012/0325480 | A1 * | 12/2012 | Schmidt | E21B 10/32 166/298 |

* cited by examiner

WELL BORE CASING MILL WITH EXPANDABLE CUTTER BASES

CROSS REFERENCE TO RELATED APPLICATIONS

This regular patent application claims priority to U.S. Provisional Patent Application Ser. No. 61/681,670, filed Aug. 10, 2012, for all purposes.

BACKGROUND

Various tools have been developed for downhole cutting or severing of casing strings in wellbores, and for cutting or milling window sections in casing strings. Generally, such tools have comprised a main body with multiple hinged arms or blades, which are rotated outwardly into contact with the casing (by hydraulic or other means) when the tool is in position downhole. Usually, fluid is pumped down through the drillstring and through the tool to actuate the mechanism and rotate the blades outward. Once the blades are rotated outwardly, rotation of the drillstring (and tool) causes the cutting surfaces on the blades to cut through the casing string. Fluids are pumped through the system to lift the cuttings to the surface. Known tools, however, cannot efficiently cut or sever multiple, cemented-together casing strings, and in particular cannot efficiently cut "windows" in such strings; by the term "window" is meant the cutting or milling of a section (e.g. 20') of the casing string, as opposed to simply severing same. In addition, known tools tend to form long, connected metal shavings which must be lifted from the wellbore by the fluid flow, else same become nested together downhole and potentially cause the drillstring to become stuck.

SUMMARY OF THE INVENTION

The well bore casing mill with expandable cutter bases, embodying the principles of the present invention, comprises a main body having a longitudinal bore therethrough. Means for connecting the main body to a drill string, typically threaded connections, are provided on at least the upper end of the main body. A plurality of elongated cutter bases are hingedly connected to the main body by a plurality of linkage arms, and are movable from a first position substantially recessed into the main body, to a second position extended outwardly from the main body. An operating mechanism within the main body, operable by fluid flow, moves the linkage arms and cutter bases. The linkage arms hold the cutter bases substantially parallel to the axis of the main body. A plurality of cutters are mounted on the cutter bases, and engage the casing string when the cutter bases are in an outwardly extended position.

DESCRIPTION OF THE PRESENTLY PREFERRED EMBODIMENT(S)

While a number of embodiments are possible, within the scope of the invention, with reference to the drawings some of the presently preferred embodiments can be described.

Figure 1:
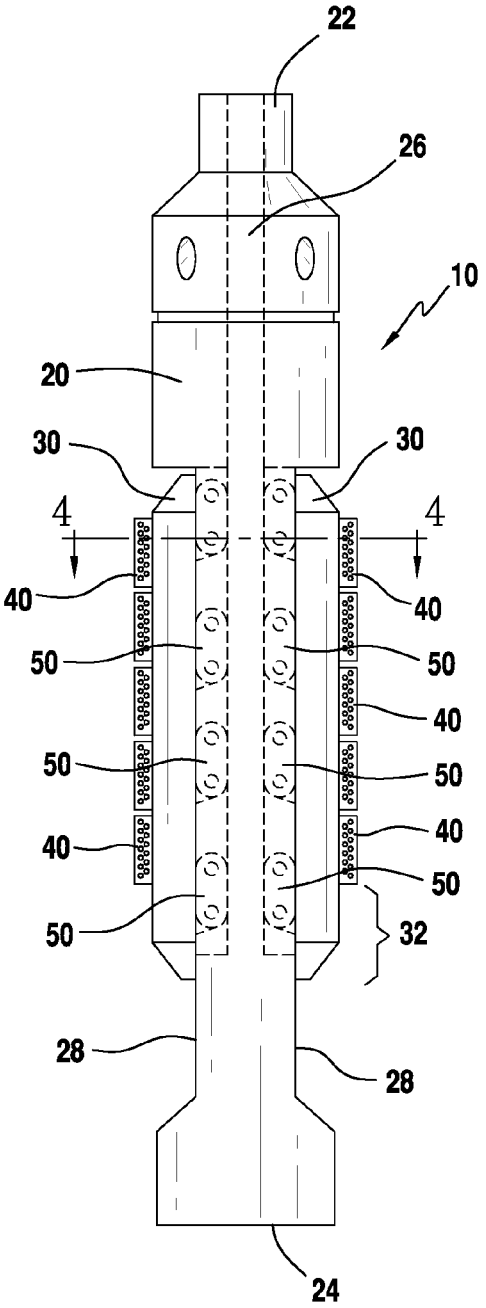
FIG. 1 is a side view in partial cutaway of an exemplary tool embodying the principles of the present invention, particularly the cutter base/cutter combination, with the cutter bases in their retracted position.

As shown in FIG. 1, the casing mill 10 comprises a main body 20, typically having a means for connection to a tubular string, referred to herein as a drillstring, said means for connection preferably being threaded connections 22 and 24 at either end. As is well known in the art, casing mill 10 is run downhole into a tubular or casing string on a drillstring. Main body 20 has a bore 26 which runs through at least a portion of the length of main body 20, sufficiently far down to route fluid to the positioning arm area, but bore 26 may not run the entire length of main body 20. By having only a partial length bore, and forcing fluid to exit the tool in the vicinity of positioning arms 50 and the recesses 28 in main body into which cutter bases 30 retract, fluid flow tends to keep these surfaces flushed and relatively free of cuttings and debris.

Attached to main body 20 by a plurality of linkage or positioning arms 50 are cutter bases 30. In the embodiment shown in the drawings, casing mill 10 has two cutter bases 30, but other numbers are possible within the scope of the invention. Positioning arms 50 are substantially of equal length, so it is understood that when cutter bases 30 are in an extended position as in FIG. 2, cutter bases 30 are substantially parallel to the longitudinal axis of main body 20. Positioning arms 50 are hingedly attached to both main body 20 and to cutter base 30. It is to be understood that the invention encompasses different numbers of positioning arms; generally, a minimum of two are required (one actuated arm and at least one additional arm), but a greater number may be used depending upon the particular tool dimensions.

Figure 2:
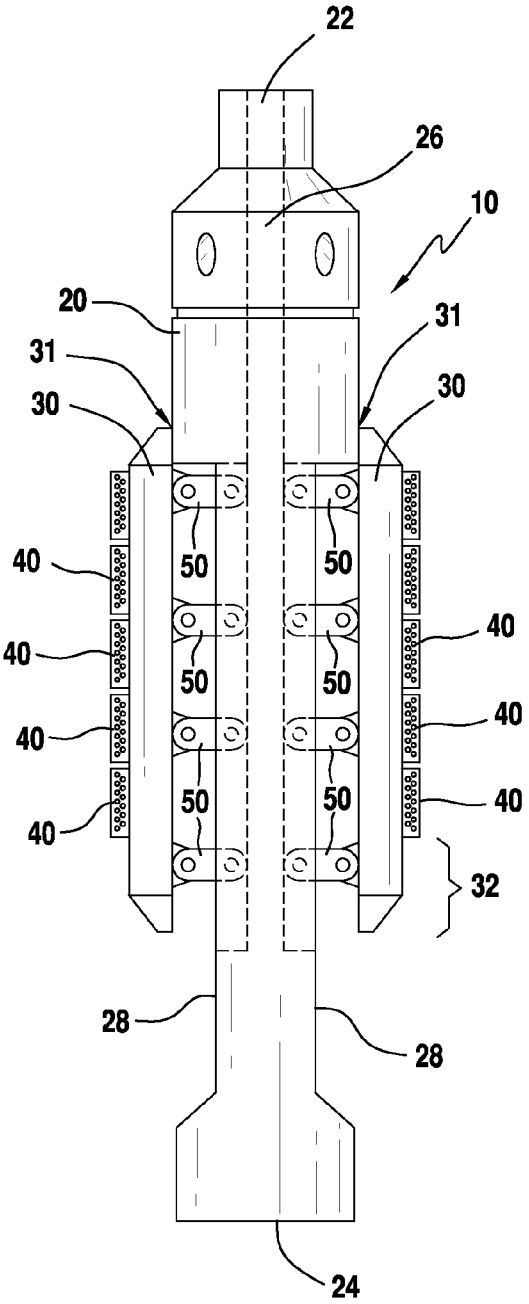
FIG. 2 is another side view in partial cutaway of an exemplary tool embodying the principles of the present invention, corresponding to the tool in FIG. 1, showing the cutter bases in their extended position.

Casing mill 10 comprises a means for moving cutter bases 30 from a first, retracted position, generally within main body 20 and not protruding significantly therefrom, as shown in FIG. 1; to a second, extended position, wherein cutter bases 30 are partially or fully extended from the body, as seen in FIG. 2. This means for moving cutter bases may comprise an operating mechanism generally utilizing fluid pumped down the bore of the drillstring and main body 20 to actuate said operating mechanism. While not confining the current invention to any particular operating mechanism, one suitable mechanism is that disclosed in U.S. Pat. No.

Figure 2A:
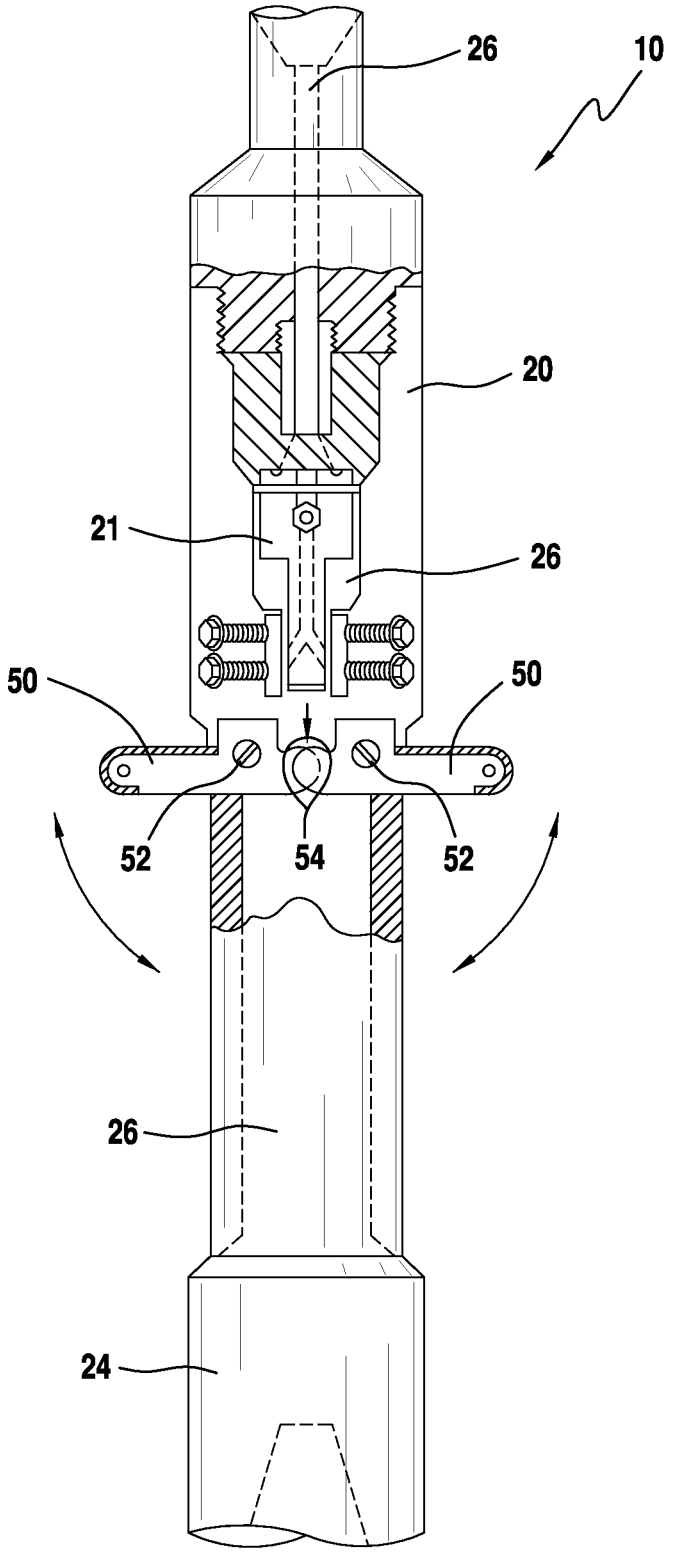
FIG. 2A shows further detail of an exemplary operating mechanism to move the cutter bases between retracted and extended positions.

7,063,155, owned by the assignee of this invention. The disclosure of that patent is incorporated herein to the extent necessary to illustrate an exemplary operating mechanism. Referring also to FIG. 2A, generally, suitable operating mechanisms employ a piston 21 disposed in the bore of main body 20. The piston itself has a bore of smaller diameter than the bore in which it is disposed; therefore, fluid pumped down bore 26 of main body 20 forces the piston downward, pushing on a heel portion of an positioning arm 50 and causing it to rotate about a pin 52. It is understood that only one of positioning arms 50 per cutter base 30 need be actuated; generally the uppermost of positioning arms 50 on each cutter base 30 is actuated. FIG. 2A shows further detail of an exemplary operating mechanism. For clarity, cutter bases 30 and some of the plurality of positioning arms 50 are omitted; the internal operating piston and a pair of operating arms 50 are shown, with heel portions 54 noted.

Figure 6:
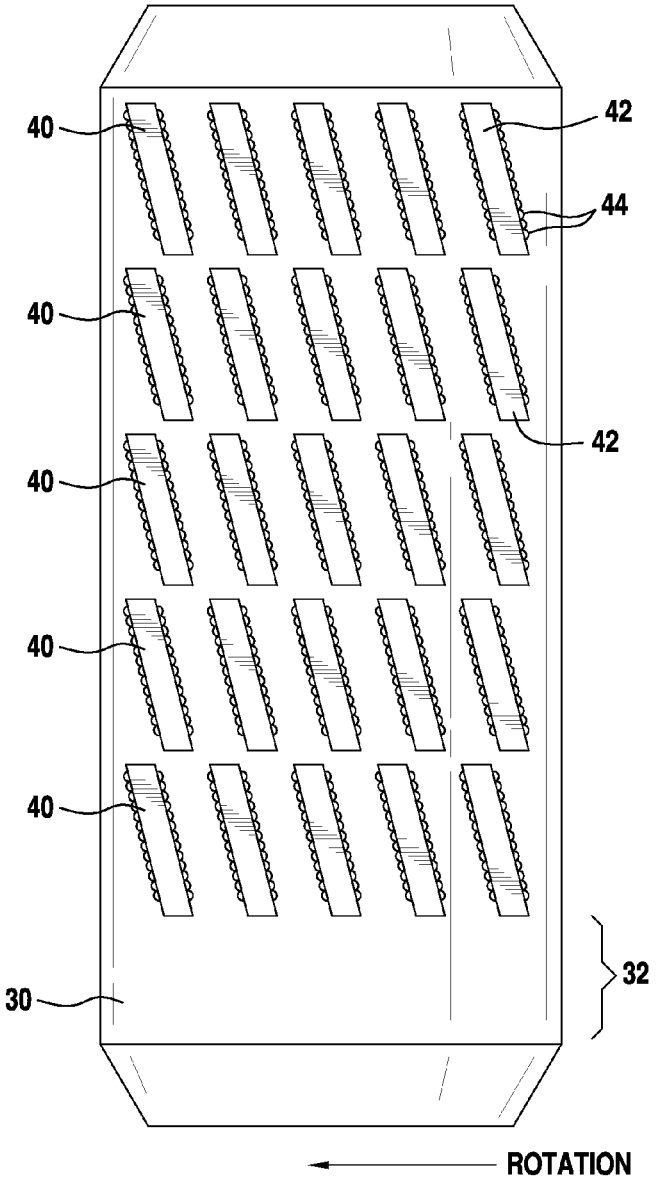
FIG. 6 is a face-on (i.e. looking radially inward) view of a cutter base, showing an exemplary arrangement of cutters disposed on the cutter base.
Figure 7:
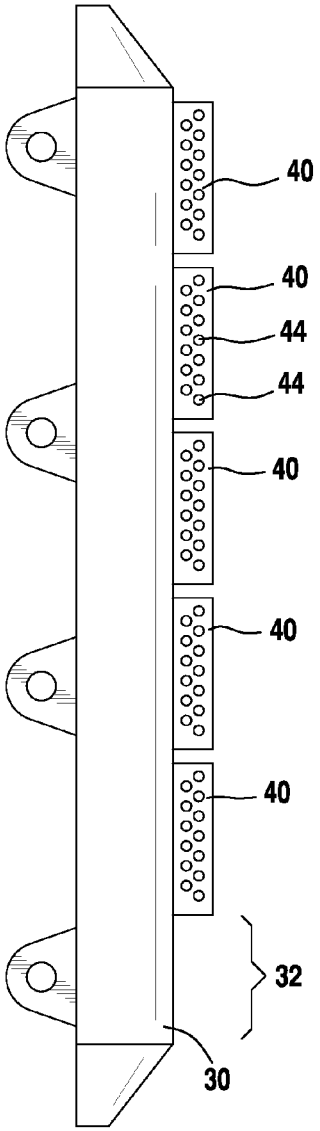
FIG. 7 is a side view of a cutter base, showing an exemplary arrangement of cutters disposed on the cutter base.

Referring especially to FIGS. 6 and 7, cutter bases 30 comprise a plurality of cutters 40 mounted thereon (for space and clarity, not all of cutters 40 are so annotated). While various embodiments of cutters may be used, one suitable embodiment uses a metal base or cutter plate which is attached to cutter base 30 by welding or similar means; on the cutter plate is attached a plurality of metal cutting surfaces, such as carbide buttons or inserts, or hardened buttons of other materials, or other means known in the art; alternatively the cutter plates may be covered with carbide or other suitable hardened surface, or a combination of hardened material buttons and carbide or similar materials. A variety of cutting surfaces are suitable, as long as they present a hardened surface to the upward-facing casing edge to permit milling of same. Further detail regarding acceptable cutting surfaces is set forth below.

As can be seen in FIGS. 6 and 7, cutters 40 are preferably arranged in a plurality of vertically spaced apart rows along the length of cutter base 30. To facilitate milling in a downward direction, with conventional right-hand rotation of the drillstring, cutters 40 may be angled or inclined as can be seen in FIG. 6, wherein an upper end of cutters 40 is inclined in a direction of rotation of casing mill 10. The number, position, and spacing of cutters 40 may be varied to suit particular applications. With cutters 40 positioned in a plurality of vertically spaced apart, horizontally aligned rows, as in FIG. 6, it can be appreciated that as milling progresses, and a row of cutters wears out, the diameter of the cutters decreases such that the next row of cutters above moves downward into contact with the casing surface. In this manner, a fresh cutting surface is presented to the casing edge being milled. It can be appreciated that the multiple rows of cutters permit the tool to remain in the hole for an extended period, thereby greatly reducing time spent in pulling and re-dressing the casing mill tool. By way of example, each row of cutters may be approximately 1" apart (vertically) from the adjacent row.

Figure 3:
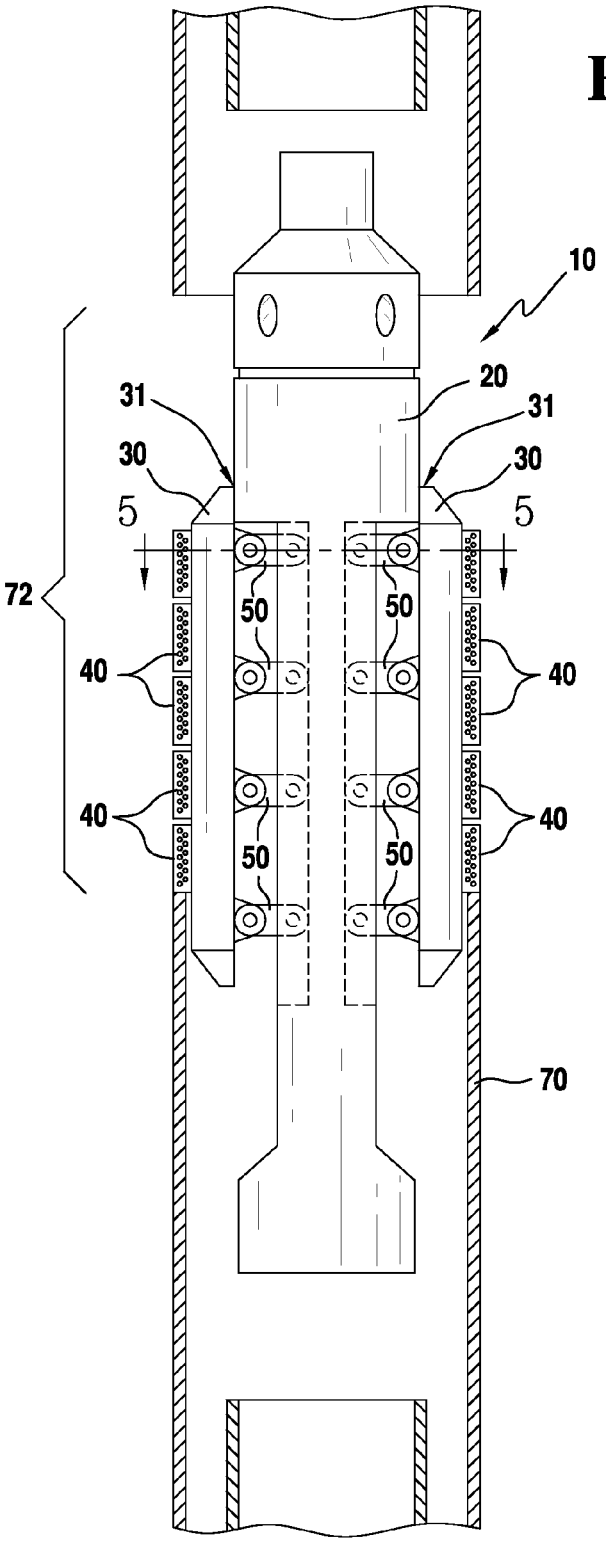
FIG. 3 is a view of an exemplary tool positioned downhole in a tubular (casing) string, showing the cutter bases in an extended position and the tool in a position to mill casing.
Figure 4:
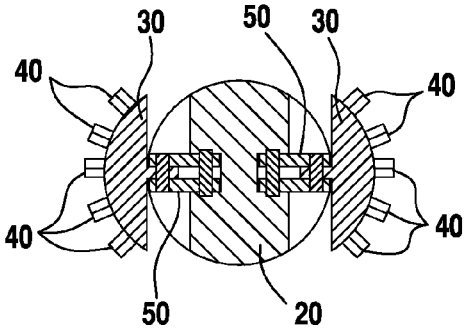
FIG. 4 is a section view along the section line indicated in FIG. 1, showing the cutter bases in an extended position.
Figure 5:
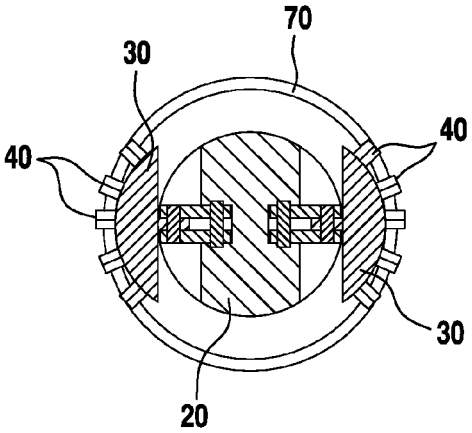
FIG. 5 is another section view along the section line indicated in FIG. 3, showing the cutter bases in an extended position, and showing the cutters positioned over the casing edge.

FIG. 4 is a view along the section line shown in FIG. 1. Cutter bases 30 are in an extended position, namely the position shown in FIGS. 3 and 5. Generally, cutter bases 30 are sized so as to fit generally within the radius of main body 30 when retracted. The dimensions of positioning arms 50 and cutter bases 30 yield sufficient outward radius to position cutters 40 over the edge of casing 70 in order to mill same, as can be seen in FIG. 5. Dimensions of cutter base 30 are therefore dependent upon the size of casing 70 being milled, and upon the dimensions of main body 20 and positioning arms 50. Likewise, the dimensions of cutters 40 in a radially outward direction may be adjusted as necessary to suit particular jobs.

FIGS. 3 and 5 show casing mill 10 in an operating position. Referring first to FIG. 3, a section of casing 70 is shown in which a window section 72 has already been milled. Cutter bases 30 are fully extended on positioning arms 50, so as to bring the outer surface of cutter bases 30 to or nearly to the inner wall of casing 70, and the lower, cutting surface of cutters 40 against the edge of casing 70. It is understood that, as well known in the art, FIG. 3 shows casing mill 10 in a downhole position, run downhole on a drillstring (not shown), and being rotated in a conventional, right hand direction, as noted in FIG. 6. Fluid is also being pumped through the drillstring and through casing mill 10, and circulated back uphole.

With fluid circulation ongoing, thereby extending cutter bases 30 and cutters 40 to the position shown in FIG. 3, casing mill 10 is lowered so that cutters 40 engage the upper surface of casing 70. The drillstring and casing mill 10 are rotated while weight is applied to casing mill 10, resulting in casing 70 being milled away. Milling continues as cutters 40 are gradually worn away, since as described above once a given row or set of cutters is sufficiently worn to move down inside the casing inner diameter, the next set of cutters moves into cutting position and cutting continues.

Yet another attribute of casing mill 10 is the centering and stabilizing aspect of cutter bases 30 in conjunction with the positioning arms 50. Preferably, a section of cutter bases 30 has no cutters 40 mounted thereon, as noted in certain of the figures as stabilizing section 32. As is readily understood with reference to FIG. 3, when cutter bases 30 are in their extended position, placing them into or nearly into contact with the inner wall of casing 70, then main body 20 is centered within casing 70 and stabilized therein, and cutters 40 are properly positioned over the edge of casing 70 for optimum cutting. A second stabilizing section 32 may be provided at the upper end of each of cutter bases 30, in order to stabilize and centralize the tool while pulling it in an uphole direction.

Another preferred attribute of casing mill 10 is that the dimensions of positioning arms 50 and cutter bases 30 are such as to enable cutter bases 30 to bear against and be supported by main body 20, when cutter bases 30 are in their second, extended position; this is shown at the location noted as 31 in FIGS. 2 and 3. This attribute provides significant support to cutter bases 30, and consequently cutters 40, as weight is applied to casing mill 10 during the casing milling process.

Cutter Design

The cutters of the present invention comprise a number of structural attributes which increase the cutting efficiency of the tool, and extend the cutting life of the tool, and enable substantially higher rates of cutting than prior art tools. Said structural attributes include, but are not limited to, the following:

1. The shape and dimensions of cutters 40 are generally rectangular, with a longer dimension generally axially aligned with the longitudinal axis of the tool, as seen in the drawings.
2. When viewed in a radial direction, as can be seen in FIG. 6, cutters 40 are preferably angled (or inclined) with respect to the longitudinal axis of main body 20, and of cutter base 30, such that the non-cutting end of the cutter leads the cutting end of the cutter, in the direction of rotation or cutting; said another way, an upper end of said cutters 40 is inclined in a direction of rotation of casing mill 10. In FIG. 6, the direction of movement of the cutters is shown by the arrow, with the bottom edge of the cutter being the cutting surface. While the amount of inclination can be varied, angles of three to ten degrees from vertical are believed to be suitable.

It is understood that should the tool be configured so as to cut in an upward or uphole direction, then the direction of angle or inclination would be reversed from that shown in FIG. 6.

Another embodiment of the cutters takes the form of a chevron, where the cutters in an upper portion of cutter base 30 are inclined as for cutting in an upward direction, and the cutters in a lower portion of cutter base 30 are inclined for cutting in a downward direction, as seen in FIG. 6.

Alternatively, cutters 40 may be mounted substantially aligned with the longitudinal axis of main body 20 (i.e. "straight" or "vertically" mounted).

Figure 8A:
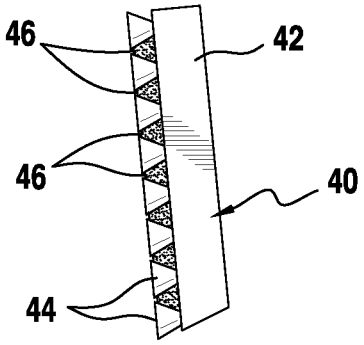
FIGS. 8A-8F show further detail of the cutters, cutter plates and buttons.
Figure 8B:
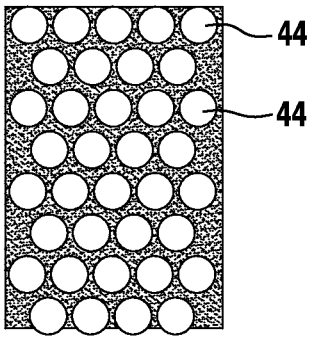
Figure 8C:
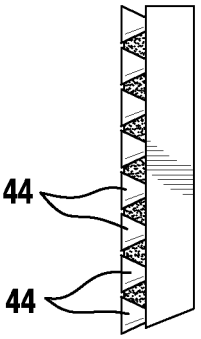
Figure 8D:
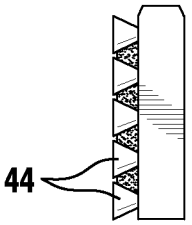
Figure 8E:
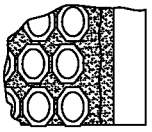
Figure 8F:
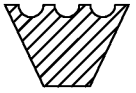

3. Cutter plate 42 is generally rectangular, formed from a selected grade of steel, forming the face of cutters 40 onto which shaped "buttons" or inserts 44 of hardened cutting material, for example tungsten carbide, are placed (on the face of the cutter), as described further below, to form the primary cutting surface. The cutter plate is intended to be worn away as the cutters rotate on and cut the casing, thereby continually exposing fresh cutting surfaces. For clarity and due to space limitations, not all of cutter plates 42 and buttons 44 are annotated.
4. A number of hardened material cutting buttons 44, for example of tungsten carbide, are placed onto cutters 40, by means well known in the art. One suitable method, known in the art, comprises fixing a desired number and pattern of buttons 44 onto the face of cutters 40 by use of tinning rods/silver solder, forming in effect a matrix (noted as 46 in FIG. 8A; omitted from the other figures for clarity) of the silver solder in which the buttons 44 sit. The geometry of each button, and the positioning of the buttons on the cutters, are important and will be described, particularly with reference to FIGS. 8A-8F.
   a. the individual buttons 44, seen in a side view, are preferably tapering toward the rear of the button; that is, the larger diameter is toward the face of the cutter, in the direction of movement of the cutter. FIGS. 8A, 8C, and 8D show an exemplary tapered profile. FIGS. 8A and 8C are two views of cutters 40, viewed radially inward. FIG. 8D is a view from the top of a cutter 40 (down its length).
   b. FIG. 8B is a view of the face of cutter 40. When buttons 44 are viewed end-on, as in FIG. 8B, the shape of the buttons 44 can be circular, or preferably comprise a multi-sided shape, such as octagonal shape, as in FIG. 8E. It is also desired that the face of the buttons comprise a single depression or multiple depressions, rather than a smooth face, as seen in FIG. 8E, with FIG. 8F being a cross-section of an exemplary button. These button face attributes (which may take the form of dimples) contribute toward a "chip breaker" design, where the metal shavings from the casing string being cut are broken into small, discrete pieces, which tend to simply fall down into the wellbore. There is no need, nor desire, to circulate such chips to the surface, hence fluids of low viscosity can be used during the cutting procedure. This is in contrast to prior art casing cutting tools, which tended to create very long unbroken metal shavings, which in turn tended to aggregate together downhole in a mass resembling everyday "steel wool." Such masses of metal cuttings could and did result in drill strings becoming stuck in the hole. Operators would therefore try to lift these long metal cuttings out of the wellbore with high viscosity fluids, which in turn created other issues.
   c. As is shown in FIGS. 7 and 8B, the individual buttons are preferably arranged on cutters 40 in a staggered axial or vertical alignment, so as to minimize any gaps in cutting coverage.

Method of Use of the Casing Mill

An exemplary method of use of casing mill 10 with expandable cutter bases 30 can now be described. A main body 20, cutter bases 30, and positioning arms 50, with multiple cutters attached to each cutter base 30, are selected with dimensions appropriate for the size casing that is to be cut. A relatively short downhole window is first cut in the tubular in interest, with a two-arm casing cutter or conventional casing mill. A window 72 of sufficient length that cutter bases 30 can fit therein is generally desired.

The next step is to locate casing mill 10 within window 72. Although various methods are possible, one preferred method is to lower casing mill 10 to a depth known to be slightly below window 72. Fluid circulation is then started, which will move cutter bases 30 (and cutters 40) outward, into contact with the casing wall. Casing mill 10 is then pulled uphole, while cutters 40 are in contact with the casing wall. When casing mill 10 is positioned within casing window 72 such that the lowermost cutters are above the casing edge, cutter bases 30 can fully extend and multiple indicators will be noted at the surface, including a decrease in drag, change in pump pressure, decrease in torque, etc. Now, the stabilizing section 32 of cutter bases 30 will be positioned against the wall of the casing, and cutters 40 will be positioned over the casing edge; this is the position seen in FIGS. 3 and 5. Fluid circulation continues so as to maintain the proper positioning of the cutter bases and cutters. Rotation of the casing mill 10 is commenced, and a desired amount of weight is applied to the casing mill, to force the lowermost cutter edges against the upward-facing casing edge and consequently commence cutting or milling of the casing. It is to be understood that the sequence of steps set forth above is only one possible method of use; same may be changed as required, including but not limited to the sequence or order of the different operations, additional steps may be added, steps may be omitted, etc.

As can be understood from FIG. 3, the multiple cutters cut the casing, thus forming the window. Field experimental use has showed that the configuration of the tungsten carbide buttons, particularly the non-smooth "chip breaker" face, results in relatively small chips of metal, rather than long, connected shavings. Such chips fall down within the wellbore and do not have to be lifted to the surface by the fluid stream, thereby permitting use of lower viscosity fluids. Further, the risk of downhole balling up of long metal shavings, and in turn sticking the drillstring, is eliminated.

Once the desired length of window has been cut, fluid flow is stopped, the cutter bases retract into the tool body, and the tool can be retrieved from the well.

As previously noted, the metal of the cutter plates 42 wears away during cutting, continuously exposing fresh tungsten carbide (or other suitable hardened material) cutting surfaces. It is believed that this is a key component in achieving the much long cutter life, and much higher casing cutting rates, than achieved by previous casing milling tools.

Yet another attribute of the cutter configuration yields information regarding how long of a casing window section has been milled. As noted above, each row of cutters 40 is spaced apart vertically by some known distance, for instance by 1". As a result, when a given row of cutters has been worn down and is then positioned within the casing inner diameter, below the window, an indication of the tool dropping slightly as the next row of cutters 40 moves into cutting position against the upward-facing casing edge and can be noted at the surface. The number of such indications, combined with known dimensions of the cutters (in a vertical direction), enables the operator to derive a close approximation of the casing footage milled.

Other Uses of the Apparatus

It is to be understood that the apparatus can be configured in other manners to address different well servicing needs, by way of example:

1. cutter bases 30 may be employed with no attachments on their outer face, to be used as a centralizer or stabilizer; or alternatively, stabilizer blades with dimensions to yield a desired outer diameter can be attached to the cutter bases 30
2. casing brushes, scrapers, or similar casing wall cleaning devices could be attached to cutter bases in lieu of cutters 40, for carrying out casing wall cleaning functions
3. with appropriate formation-cutting blades, the apparatus could be used for hole opening and/or underreaming functions.
4. the apparatus can be run in combination with other tools placed at different locations in the drillstring, such as brushes, scrapers, stabilizers, etc.

ANOTHER EMBODIMENT AND RELATED USE

Figure 9A:
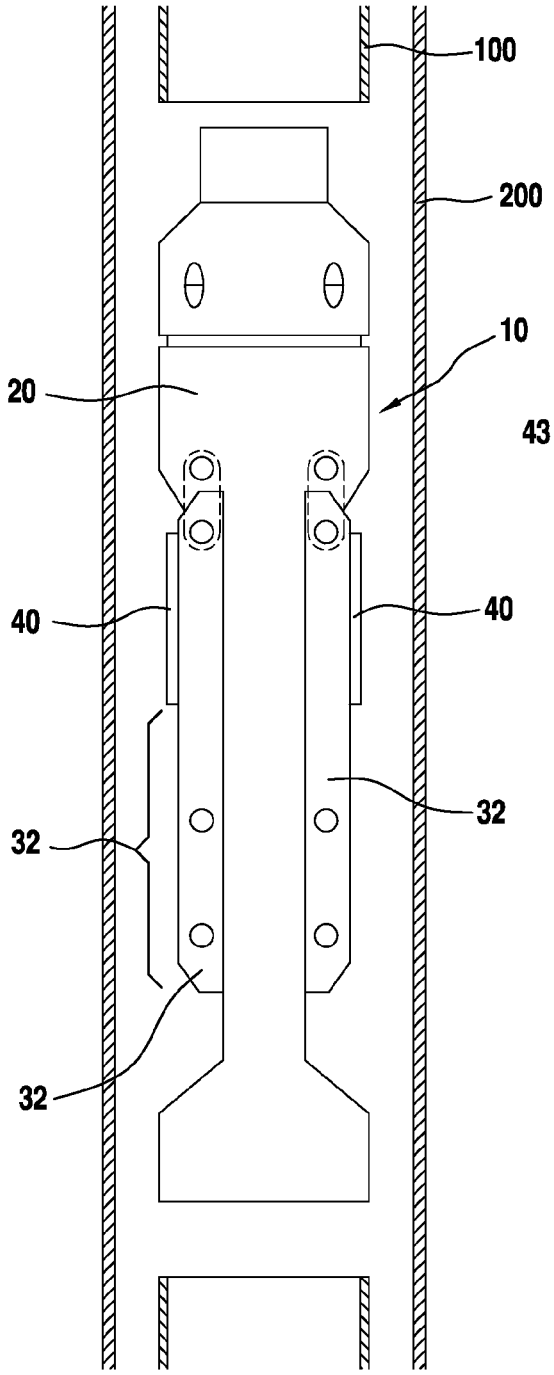
FIGS. 9A and 9B show another embodiment of the casing mill.
Figure 9B:
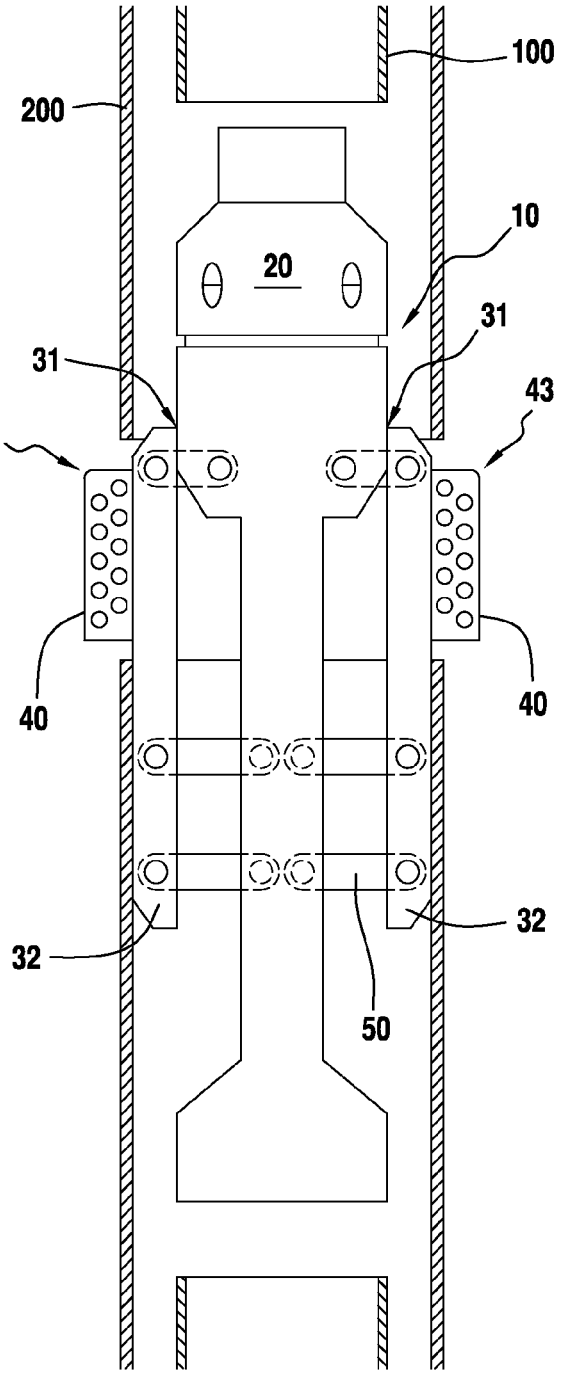

Another embodiment of the casing mill is shown in FIGS. 9A and 9B. That embodiment and a method of its use will now be described, with reference to those two figures. This embodiment is particularly suitable for both cutting the initial opening or window in the casing string to be milled, then (without the necessity of removing the tool from the well) beginning the milling process and milling substantial lengths of casing.

Casing mill 10 generally comprises a number of elements in common with the previously described embodiments. However, as seen in FIGS. 9A and 9B, stabilizing section 32 in a lower portion of cutter base 30 is generally extended to encompass a larger fraction of the overall length of cutter base 30, for example one half or more of said overall length. Cutters 40 are also generally longer than in the previously described embodiment, and by way of example may be one quarter or more of the total length of cutter base 30. In addition, the dimensions of cutters 40 in addition to the length of the cutters—namely the width (in a radial direction) of the cutters—may be changed to provide longer cutting/milling time, and/or to provide a more extended "reach" or extent of milling.

In this embodiment, it is envisioned that only a single row of such larger cutters will be used. A hardened cutting surface, which may comprise hardened cutting buttons, is preferably applied to each cutter. The cutting buttons or inserts of the present invention are arranged in rows, as can be seen from the drawings, and yield significant footage of casing milled per row of buttons or inserts (which are used up in the milling process). By way of example, each cutter may be 6" long, with sixteen rows of inserts mounted on each cutter. It is believed that such arrangement could yield on the order of 240 feet of casing milling footage, with a single row of cutters.

If desired, the shape of the outer edge of cutters 40 may be modified to better make cutters 40 to make the initial cut through the casing wall. For example, the upper outside corner of cutters 40, noted as corner surface 43, may be rounded or angled, rather than a squared-off shape, to better enable the initial cut into the casing wall. In other respects, this embodiment generally shares the structural aspects of the earlier embodiment, as can be seen in the drawings.

An exemplary method of use of this embodiment can now be described. Casing mill 10 is lowered to a desired downhole position within a casing string. By way of example only, in FIG. 9A, casing mill 10 is lowered through a section of smaller casing 100 (for example, 9⅝"), in which a window has already been milled, and into position within a section of larger casing 200 (for example, 13⅜"), in preparation for cutting through and then milling a section or window in larger casing 200. Once casing mill 10 is in the desired position, fluid flow is started, which actuates the operating mechanism (previously described), rotating positioning arms 50 outward and moving cutter bases 30 outwardly until cutters 40 engage the wall of larger casing 200. Rotation of the drillstring and casing mill 10 is then commenced, and with continued fluid pumping and rotation cutters 40 cut into and eventually through the wall of larger casing 200. Once the casing is completely cut through, surface indicators including a decrease in torque, will be noted. Now, while continuing fluid circulation and rotation, weight can be applied to casing mill 10 by slacking off on the drillstring, and milling of the larger casing 200 commences. As previously noted, milling of the casing window continues until the desired window length is achieved.

CONCLUSION

While the preceding description contains many specificities, it is to be understood that same are presented only to describe some of the presently preferred embodiments of the invention, and not by way of limitation. Changes can be made to various aspects of the invention, without departing from the scope thereof. For example, dimensions of the various components of the tool can be varied to suit particular jobs; the number of cutter bases can be varied; the number and positioning of cutters per cutter base can be varied; size and shape of the cutters can vary; the angle of the cutters on the cutter bases (that is, the angle with respect to the longitudinal axis of the tool) can be adjusted; the number, size, and placement of the tungsten carbide (or other suitable material) buttons on the cutters can be varied; the configuration of the face surfaces (both as to their multi-sided shape, and the depressions in the face) of the tungsten carbide buttons can be varied to provide the most efficient "chip breaker" shape for the application; and methods of use can ve varied.

Therefore, the scope of the invention is to be determined not by the illustrative examples set forth above, but by the appended claims and their legal equivalents.

I claim:

1. A casing mill, comprising:

an elongated main body having a longitudinal axis and a longitudinal bore therethrough and a means for attachment to a drillstring;

a plurality of elongated cutter bases hingedly connected to said main body and movable between a first position substantially retracted to said main body, and a second position extended outwardly from said main body, wherein in said first and second positions said elongated cutter bases are substantially parallel to said longitudinal axis of said main body;

one or more cutters mounted on each of said cutter bases, said cutters positioned so as to be in cutting relationship with a casing string when said cutter bases are in said second position; and a means for moving said cutter bases between said first and second positions, wherein said means for moving said cutter bases between said first and second positions comprises:

a plurality of positioning arms connecting said cutter bases to said main body, each of said plurality of positioning arms being of substantially equal length; and a piston disposed in said bore of said main body, and movable in a downhole direction by fluid flow through said bore, said piston bearing on heel portions of at least two of said positioning arms and rotating said positioning arms outwardly, in turn moving said cutter bases radially outward.

2. The casing mill of claim 1, wherein said tool comprises two or more cutters mounted on each of said cutter bases, each of said cutters comprising an elongated cutter plate at least partially covered with a cutting material.

3. The casing mill of claim 2, wherein said cutting material comprises a plurality of hardened material buttons attached to a face of said cutter plates.

4. The casing mill of claim 3, wherein said buttons comprise a multi-sided face shape.

5. The casing mill of claim 3, wherein said buttons comprise a plurality of depressions in a face of said buttons.

6. The casing mill of claim 3, wherein said buttons taper from a face to a base.

7. The casing mill of claim 3, wherein said buttons comprise a multi-sided face having a plurality of depressions therein, and a tapered profile from a face to a base portion.

8. The casing mill of claim 2, wherein said cutters are arranged in a plurality of vertically spaced-apart rows on said cutter bases.

9. The casing mill of claim 8, wherein said cutters are mounted at an angle to the longitudinal axis of said main body.

10. The casing mill of claim 9, wherein said angle is between about three and ten degrees.

11. A casing mill, comprising:

an elongated main body with a longitudinal axis and a longitudinal bore therethrough and a means for attachment to a drillstring;

a plurality of elongated cutter bases hingedly connected to said main body by a plurality of positioning arms, said cutter bases movable between a first position substantially retracted to said main body, and a second position extended outwardly from said main body, said cutter bases generally parallel to said main body when in said second position, wherein in said first and second positions said elongated cutter bases are substantially parallel to said longitudinal axis of said main body;

a piston disposed in said bore of said main body, and movable in a downhole direction by fluid flow through said bore, said piston bearing on heel portions of at least two of said positioning arms and rotating said positioning arms outwardly, in turn moving said cutter bases radially outward; and a plurality of cutters mounted on each of said cutter bases, said cutters comprising a cutter plate having a hardened cutting surface disposed thereon.

12. The casing mill of claim 11, wherein said cutters are disposed on said cutter bases in a plurality of vertically spaced apart rows.

13. The casing mill of claim 12, wherein said hardened cutting surface comprises a plurality of hardened material buttons attached to a face of said cutters.

14. The casing mill of claim 13, wherein said buttons comprise a face having a multi-sided shape, a plurality of depressions in said face, and wherein said buttons are tapered from a larger dimension at said face to a smaller dimension at a base.

15. The casing mill of claim 14, wherein said cutters are angled such that an upper end of said cutters is inclined in a direction of rotation of said casing mill.

16. A method for milling sections of a casing string, comprising the steps of:

a. providing a casing mill, comprising:

an elongated main body having a bore and a means for attachment to a drillstring;

a plurality of elongated cutter bases hingedly connected to said main body and movable between a first position substantially retracted to said main body, and a second position extended outwardly from said main body;

one or more cutters mounted on each of said cutter bases, said cutters positioned so as to be in cutting relationship with a casing string when said cutter bases are in said second position, said cutters at least partially covered in a hardened cutting material, said cutters disposed on said cutter bases in a plurality of vertically spaced apart rows; and a means for moving said cutter bases between said first and second positions, said means for moving responsive to fluid pumped through said main body;

b. lowering said casing mill on a drillstring into a wellbore comprising one or more casing strings, to a desired position within said wellbore where a previously cut window exists in at least one of said casing strings;

c. pumping fluid through said drillstring and said main body, thereby causing said means for moving said cutter bases between said first and second positions to move said cuter bases to said second position, placing said cutters into cutting position proximal an upward facing edge of one of said casing strings;

d. rotating and lowering said casing mill to engage said cutters on said upward facing casing edge with a desired weight;

e. continuing rotation on said casing until a row of cutters wears sufficiently to drop fully within the string of casing being milled;

f. detecting when said row of cutters drops into said casing string by surface indicators.

17. The method of claim 16, further comprising the steps of:

g. determining the footage of casing milled by a row of cutters;

h. determining the footage of casing which can be milled on a given casing mill run using the footage milled by a row of cutters and the number of rows of cutters available.

18. A downhole tool for cutting an entry window in a casing string, and for milling an extended window in said casing string thereafter, comprising:

an elongated main body with a bore and a means for attachment to a drillstring;

a plurality of elongated cutter bases hingedly connected to said main body by a plurality of positioning arms, said cutter bases movable between a first position substantially retracted to said main body, and a second position extended outwardly from said main body, said cutter bases generally parallel to said main body when in said first and second positions;

a piston disposed in said bore of said main body, and movable in a downhole direction by fluid flow through said bore, said piston bearing on heel portions of said positioning arms and rotating said positioning arms outwardly, in turn moving said cutter bases radially outward; and a plurality of cutters mounted on each of said cutter bases, said cutters comprising a cutter plate having a hardened cutting surface disposed thereon, said cutters disposed in a single row on said cutter base, wherein said hardened cutter surface comprises a plurality of cutting inserts on a cutting face of said cutter, and wherein said cutters extend along only a portion of the length of said cutter base, leaving a sufficient length of said cutter base proximal a lower end of said cutter base having no cutters thereon and comprising a stabilizer section to stabilize said downhole tool within a casing string when said cutter bases are in said second position.

19. A method for cutting an entry window in a casing string, and for milling an extended window in said casing string thereafter, comprising the steps of:

a. providing a casing mill, comprising:

an elongated main body with a bore and a means for attachment to a drillstring;

a plurality of elongated cutter bases hingedly connected to said main body by a plurality of positioning arms, said cutter bases movable between a first position substantially retracted to said main body, and a second position extended outwardly from said main body, said cutter bases generally parallel to said main body when in said second position;

a piston disposed in said bore of said main body, and movable in a downhole direction by fluid flow through said bore, said piston bearing on heel portions of said positioning arms and rotating said positioning arms outwardly, in turn moving said cutter bases radially outward; and a plurality of cutters mounted on each of said cutter bases, said cutters comprising a cutter plate having a hardened cutting surface disposed thereon, said cutters disposed in a single row on said cutter base, wherein said hardened cutter surface comprises a plurality of cutting inserts on a cutting face of said cutter, and wherein said cutters extend along only a portion of the length of said cutter base, leaving a sufficient length of said cutter base having no cutters thereon to stabilize said downhole tool within a casing string when said cutter bases are in said second position;

b. lowering said downhole tool on a drillstring into a wellbore comprising one or more casing strings, to a desired position within a casing string to be cut through and milled;

c. pumping fluid through said drillstring and said main body, thereby causing said means for moving said cutter bases between said first and second positions to move said cutter bases to said second position, placing said cutters into cutting engagement with said casing string;

d. rotating said downhole tool while pumping fluid, thereby causing said cutters to cut into said casing string;

e. continuing rotation until said cutters have cut through said casing string, creating an upward facing casing edge;

f. detecting when said cutters have cut through said casing string by surface indicators;

g. rotating and lowering said casing mill to engage said cutters on said upward facing casing edge with a desired weight; and h. continuing rotating and lowering said casing mill until a desired length of casing has been milled, forming a window therein.

* * * * *